US012145040B2

(12) United States Patent
Nadel et al.

(10) Patent No.: US 12,145,040 B2
(45) Date of Patent: Nov. 19, 2024

(54) PITCH TRAINING ATTACHMENT FOR A MECHANICAL EXERCISE TRAINING SYSTEM

(71) Applicants: Robert Geoffrey Nadel, Winchester, MA (US); Richard Nadel, Winchester, MA (US)

(72) Inventors: Robert Geoffrey Nadel, Winchester, MA (US); Richard Nadel, Winchester, MA (US)

( * ) Notice: Subject to any disclaimer, the term of this patent is extended or adjusted under 35 U.S.C. 154(b) by 0 days.

(21) Appl. No.: 18/443,697

(22) Filed: Feb. 16, 2024

(65) Prior Publication Data

US 2024/0325842 A1 Oct. 3, 2024

Related U.S. Application Data

(62) Division of application No. 18/194,734, filed on Apr. 3, 2023, now Pat. No. 11,969,637.

(51) Int. Cl.
*A63B 69/00* (2006.01)
*A63B 102/18* (2015.01)

(52) U.S. Cl.
CPC ..... *A63B 69/0002* (2013.01); *A63B 69/0091* (2013.01); *A63B 2069/0006* (2013.01); *A63B 2102/18* (2015.10); *A63B 2102/182* (2015.10)

(58) Field of Classification Search
CPC ..... A63B 69/0091; A63B 2069/0006
USPC ..... 473/424, 451
See application file for complete search history.

(56) References Cited

U.S. PATENT DOCUMENTS 4,417,730 A * 11/1983 Weiner ..... A63B 69/0091 473/426
4,460,172 A * 7/1984 Hogan ..... A63B 69/0091 473/426
5,158,517 A 10/1992 Steggert
5,250,016 A * 10/1993 Higgins ..... A63B 21/0552 482/121
5,423,730 A 6/1995 Hirsch
5,957,788 A 9/1999 Eze
7,217,202 B2 5/2007 Troxell
(Continued)

FOREIGN PATENT DOCUMENTS

WO 0021617 A1 4/2000
WO 2009100393 A2 8/2009
WO 2015073929 A1 5/2015

*Primary Examiner* — Mitra Aryanpour
(74) *Attorney, Agent, or Firm* — Carson Patents; Gregory D Carson

(57) ABSTRACT

The Pitch Training Attachment for a Mechanical Exercise Training System is a pitch training device or apparatus in the form of a spinning ball that can simulate any ball requiring gripping by the hand. In use, it is attached to a three-dimensional resistance means. The purpose of the pitch training device is to provide strengthening, rehabilitation, and/or correct body motion mechanics training to improve pitching quality, speed, strength, and body mechanics. This enables training, exercising, and rehabilitation of proper body motion mechanics for improving the act of pitching and increasing the performance (speed and/or accuracy) of the act by enabling weighted ball training wherein the weight of the ball is connected to and maintained in the center of the ball and the center of mass of the weight is maintained in the center (physical, geometric, and/or dimensional) of the ball.

14 Claims, 3 Drawing Sheets

(56) References Cited

U.S. PATENT DOCUMENTS

| | | | | |
|---|---|---|---|---|
| 7,374,502 | B2 * | 5/2008 | Comello, Jr. ..... | A63B 21/4017 473/422 |
| 7,445,569 | B2 | 11/2008 | Comello, Jr. | |
| 7,517,290 | B1 | 4/2009 | Springer | |
| 7,699,724 | B1 | 4/2010 | Derisse | |
| 8,574,101 | B2 | 11/2013 | Wheelbarger et al. | |
| 9,135,347 | B2 | 9/2015 | Damman et al. | |
| 10,188,924 | B1 * | 1/2019 | Vickery ..... | A63B 23/14 |
| 11,439,881 | B1 * | 9/2022 | Nadel ..... | A63B 69/0091 |
| 2003/0087733 | A1 | 5/2003 | Kim | |
| 2006/0199673 | A1 | 9/2006 | Littlejohn | |
| 2010/0204020 | A1 * | 8/2010 | Thomas ..... | A63B 23/03525 482/131 |
| 2022/0008798 | A1 * | 1/2022 | Fuchs ..... | A63B 69/38 |
| 2023/0264087 | A1 * | 8/2023 | Nadel ..... | A63B 69/0091 473/424 |

* cited by examiner

PITCH TRAINING ATTACHMENT FOR A MECHANICAL EXERCISE TRAINING SYSTEM

REFERENCE TO RELATED PATENTS

This application, which discloses and claims only subject matter disclosed in prior application Ser. No. 18/194,734, filed 3 Apr. 2023, appears to claim only subject matter directed to an invention that is independent and distinct from that claimed in the prior application, and names the inventor or at least one joint inventor named in the prior application. Accordingly, this application constitutes a divisional application. Applicant desires to claim the benefit of the filing date of the prior application, attention is directed to 35 U.S.C. 120, 37 CFR 1.78, and MPEP § 211 et seq. This application is related to U.S. Pat. No. 11,439,881 B1 by the same inventors.

STATEMENT REGARDING PRIOR DISCLOSURES BY THE INVENTOR OR JOINT INVENTOR

Inventor has disclosed the contents of the present invention under a research and development agreement with Datum3D starting June 2022.

TECHNICAL FIELD OF THE INVENTION

This invention relates generally to a training device or apparatus in the form of a spinning ball having an attachment rod for connection to a mechanical exercise training system and then used for training people to throw a ball, exercising the motions required to throw a ball, and for rehabilitation of the muscles involved throwing a ball.

This invention relates generally to a ball throwing training device or apparatus in the form of a spinning ball having an attachment rod for connection to a mechanical exercise training system and then used for training people to throw a ball, exercising the motions required to throw a ball, and for rehabilitation of the muscles involved throwing a ball.

This invention relates specifically to a pitch training device or apparatus in the form of a spinning ball having an attachment rod for connection to a mechanical exercise training system and then used for training people to pitch a ball, baseball, or softball, for exercising the motions required to pitch a ball, baseball, or softball, and for rehabilitation of the muscles involved pitching a ball, baseball, or softball.

This invention relates specifically to a pitch training device or apparatus in the form of a spinning ball having an attachment rod for connection to a mechanical exercise training system and then used for training people to pitch a ball, baseball, or softball, for exercising the motions required to pitch a ball, baseball, or softball, and for rehabilitation of the muscles involved pitching a ball, baseball, or softball, wherein said mechanical exercise training system comprises a three-dimensional resistance means for the purpose of providing strengthening, rehabilitation, and/or correct body motion mechanics training to improve pitching quality, speed, strength, and body mechanics.

BACKGROUND

Not including the above referenced related application, there are only limited devices, apparatus, and methods available for exercising and or rehabilitating the act of pitching a baseball. There are available today even fewer limited devices, apparatus, and methods available for teaching or training the proper and/or most effective and efficient body movements for performing the act of throwing a ball, and specifically pitching a baseball.

Available today are devices and apparatus that are normally weighted and added weight baseball-sized balls, balls attached to strings and rods, and balls of various sizes attached to strings and/or rods connected to pulleys and weights to impart a force or resistance (weight) to the attached ball. Available today are a few options for physical therapy and/or training the proper body motion and mechanics involved in expert or professional player performance of the act of pitching that include the usual treatment and therapy modalities for assisting in healing and restoring proper body motion mechanics.

The present devices, apparatus, and methods available all suffer from at least one of these limitations: the attachment for the string or rod to connect the ball is on the surface of the ball not from the center of the ball; the added weight shifts off-center away from the actual center of the ball inside the ball when used; and the attachment between the ball and any applied force of resistance is too flexible to transfer a mechanically applied force of resistance.

Further the present devices, apparatus, and methods available all suffer from a lack of rotational motion for a ball or simulated ball used for training, exercise, or rehabilitation making the motion/movement inconsistent and not smooth.

In light of the foregoing prior art, there is a need for a pitch training device or apparatus to better enable training, exercising, and rehabilitation of proper body motion mechanics for improving the act of pitching and increasing the performance (speed and/or accuracy) of the act. Further, there is a need for a pitch training device or apparatus that better enables connection to a ball at the center of the ball instead of the side or edge. Further, there is a need for a pitch training device or apparatus that better enables a weighted (applied force of resistance) connection to a ball at the center of the ball instead of the side or edge wherein the center of mass of the weight does not shift off-center within the ball.

BRIEF SUMMARY OF THE INVENTION

According to a first aspect of the invention there is a baseball simulator comprising a spherical cage having an opening surrounding an attachment rod having a free end opposite an attachment end, and a first axel comprising a first wheel opposite a second wheel operatively attached at a first axel midpoint between said first wheel and said second wheel to said attachment end.

According to a second aspect of the invention there is a baseball simulator wherein said first axel further comprises a rotating axel connection operatively connecting said first axel midpoint to said attachment end of said attachment rod.

According to a third aspect of the invention there is a baseball simulator further comprising a second axel configured with a third wheel operationally attached at a second axel midpoint to said attachment end of said attachment rod.

According to a fourth aspect of the invention there is a baseball simulator further comprising a plurality of axels, one of said plurality of axels being said first axel, having attached a plurality of wheels, one of said plurality of wheels being said first wheel.

According to a fifth aspect of the invention there is a baseball simulator where any wheel further comprises an omni-directional wheel.

According to a sixth aspect of the invention there is a pitch training attachment to a mechanical exercise training system (METS) for training people to pitch a baseball comprising a baseball simulator having an attachment rod operationally attached to said METS.

According to a seventh aspect of the invention there is a pitch training attachment further comprising a spherical cage having an attachment rod connector operationally attached to said attachment rod and a machine connector operationally attached to said METS.

According to an eighth aspect of the invention there is a pitch training attachment wherein said spherical cage is configured for spinning about a center of said spherical cage.

According to a ninth aspect of the invention there is a pitch training attachment wherein said machine connector is configured for turning axially about its connection to said METS.

According to a tenth aspect of the invention there is a pitch training attachment wherein said machine connector is configured for rotating about its connection to said METS.

According to an eleventh aspect of the invention there is a pitch training attachment further comprising a first connection rod, a rotating ball joint having a rotating base, a first socket, a first ball, and a first connection end, and an angled rotating ball joint having a base, a second socket, a second ball, and a second connection rod wherein said first connection end is connectively attached to said first connection rod, said rotating base is operationally attached to said base, and said attachment rod is connectively attached to said second connection rod.

According to a twelfth aspect of the invention there is a pitch training attachment wherein said rotating ball joint further comprises a first spherical sleeve inserted between said first ball and said first socket, and said angled rotating ball joint further comprises a second spherical sleeve inserted between said second ball and said second socket.

According to a thirteenth aspect of the invention there is a pitch training attachment wherein said attachment rod is connectively attached to an axel having a first omni-directional wheel and a second omni-directional wheel at opposing ends.

According to a fourteenth aspect of the invention there is a pitch training attachment wherein said axel further comprises at least a third omni-directional wheel.

According to a fifteenth aspect of the invention there is a pitch training attachment wherein said baseball simulator further comprises a ball joint having a third ball, a third socket, and a third connection rod wherein said attachment rod is connectively attached to said third connection rod.

According to a sixteenth aspect of the invention there is a pitch training attachment wherein said ball joint further comprises a spherical sleeve inserted between said third ball and said third socket.

According to a seventeenth aspect of the invention there is a pitch training attachment wherein said METS further comprises a three-dimensional resistance machine.

According to an eighteenth aspect of the invention there is a pitch training attachment wherein said METS further comprises a controlled motion three-dimensional exercise machine.

According to a nineteenth aspect of the invention there is a pitch training attachment further comprising a spherical cage configured to position said baseball simulator in its center.

According to a twentieth aspect of the invention there is a pitch training attachment further comprising a spherical cage operatively attached to said second connection rod configured to position said baseball simulator in its center.

An advantage of the pitch training device or apparatus of the present invention is that it enables training, exercising, and rehabilitation of proper body motion mechanics for improving the act of pitching and increasing the performance (speed and/or accuracy) of the act. Further, the pitch training device or apparatus of the present invention enables connection to a ball at the center of the ball instead of the side or edge. Further, the pitch training device or apparatus of the present invention enables a weighted (applied force of resistance) connection to a ball at the center of the ball instead of the side or edge wherein the center of mass of the weight does not shift off-center within the ball.

An advantage of the pitch training device or apparatus of the present invention is that it enables gripping in a ball like hand grasping motion An advantage of the pitch training device or apparatus of the present invention is that it enables rotational motion for a ball or simulated ball used for training, exercise, or rehabilitation making the motion/movement consistent and smooth.

The invention will now be described, by way of example only, with reference to the accompanying drawings as described below.

DETAILED DESCRIPTION

Figure 1:
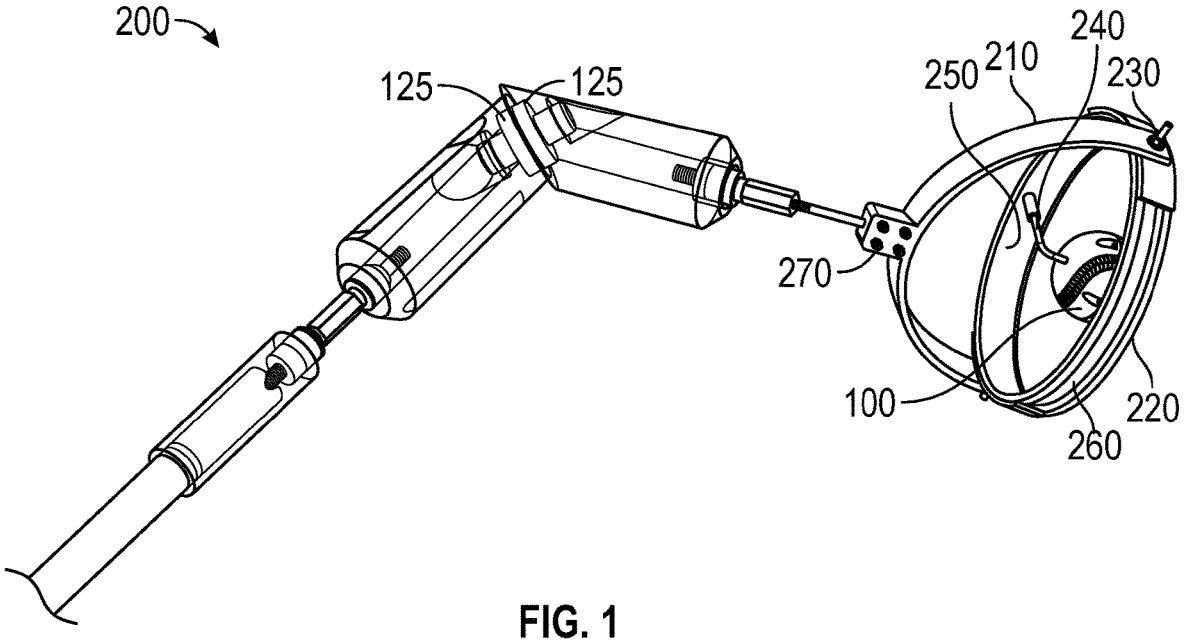
FIG. 1 is a perspective view of a spherical cage pitch training device with spinning ball attached to a pair of angled rotating ball joints shown attached to an exercise machine according to the invention.
Figure 2:
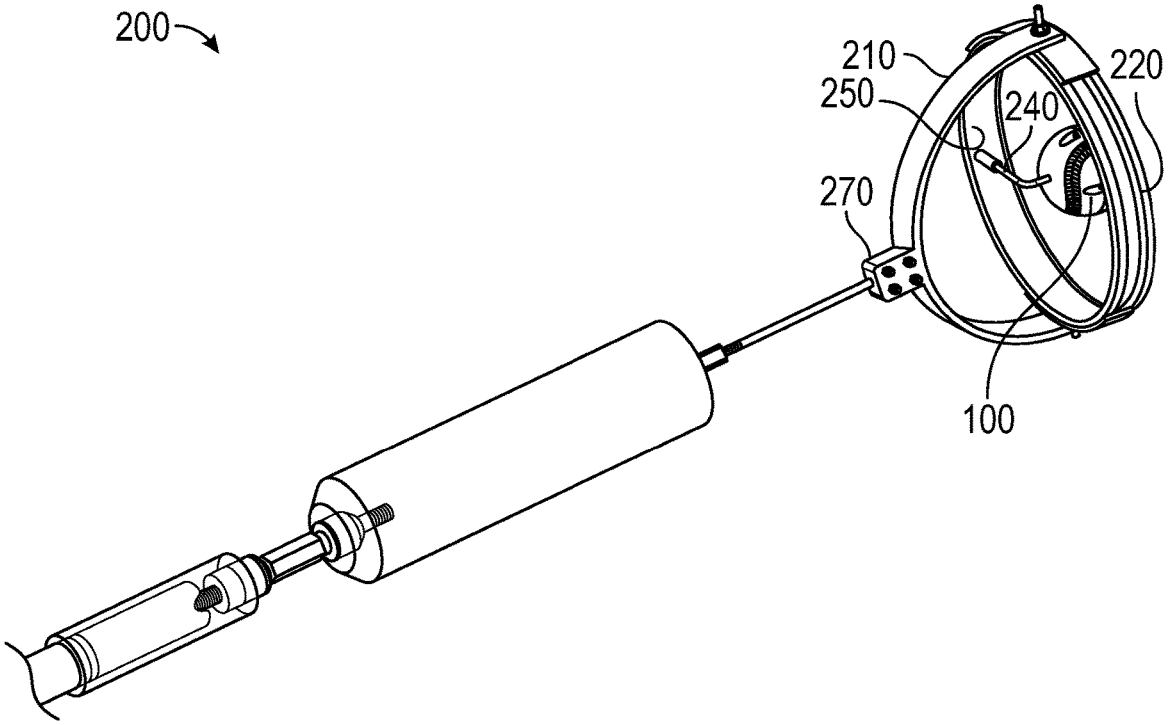
FIG. 2 is a perspective view of a spherical cage pitch training device with spinning ball attached to a rotating ball joint according to the invention.

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Throughout this specification, the phrase "mechanical exercise training system" will be understood to imply a training system and/or exercise system comprising a combination of one or more different exercise forms and/or physical rehabilitation therapies used to treat injuries and enhance physical performance in people.

Throughout this specification, the phrase "body motion mechanics" will be understood to imply the physical movements of a human body involved in mechanically accomplishing a given motion or movement based task.

Throughout this specification, the phrase "controlled motion three-dimensional exercise machine" or "three-dimensional exercise machine" or "three-dimensional resistance machine" will be understood to imply a mechanical means to provide a consistent, adjustable, or variable force of resistance at any point in a given volume that said device can move or articulate about within said volume. This includes that said mechanical means is able to provide a consistent, adjustable, or variable force of resistance at any point in a given volume that said device can move or articulate about within said volume across any path of motion that said mechanical means can move within.

Index of Labelled Features in Figures. Features are listed in numeric order by Figure in numeric order. Referring to the Figures, there is shown in FIGS. 1 through 11 the following features:

Element 100 which is baseball simulator sometimes shown having a two wheeled axel.

Element 101 which is baseball simulator having a five wheeled axel arrangement.

Element 102 which is baseball simulator having a solid core or a solid baseball simulator.

Element 110 which is an attachment rod.

Element 112 which is a first axel.

Element 113 which is a second axel.

Element 114 which is a first wheel.

Element 116 which is a second wheel.

Element 117 which is an omni-directional wheel.

Element 118 which is a rotating axel.

Element 120 which is a spherical shell.

Element 125 which is a rotating ring, wherein element 125A is a right side and 125B is a left side.

Element 130 which is a ball joint.

Element 132 which is a rotating joint connection head receiver.

Element 134 which is a spherical socket shaped and dimensioned to mate to a ball as in element 150 below.

Element 140 which is a ball sleeve.

Element 150 which is a ball component of a ball joint as connected to a rod.

Element 160 which is a rotatable sleeved ball joint.

Element 162 which is a rotatable sleeved ball joint connection head.

Element 170 which is a connection rod.

Element 180 which is an angled rotatable sleeved ball joint.

Element 182 which is an angled rotatable sleeved ball joint connection head.

Element 200 which is a spherical cage pitch training attachment to a mechanical exercise training system (METS) having a baseball simulator (100, 101, or 102).

Element 210 which is a hemispherical frame of a spherical cage (200) for holding and surrounding a baseball simulator (100, 101, or 102). Hemispherical frame shown in a moon-like crescent-shaped rail.

Element 220 which is an outer ring spherical band element of a spherical cage.

Element 230 which is a spherical band and spherical frame swiveling attachment point.

Element 240 which is a spherical cage attachment rod for connecting to a baseball simulator (100, 101, or 102).

Element 250 which is an inner ring spherical band element of a spherical cage.

Element 260 which is a spherical rotating ring element of a spherical cage.

Element 270 which is rotating and spinning attachment point for a spherical cage.

This invention relates generally to a pitch training device or apparatus in the form of a linearly extending attachment having a rotating connection point for connection to a baseball simulator 100, 101, or 102 that is attached to a resistance means for the purpose of providing strengthening, rehabilitation, and/or correct body motion mechanics training to improve pitching quality, speed, strength, and body mechanics.

This invention relates specifically to a pitch training device or apparatus in the form of a linearly extending attachment having a rotating connection point with a spherical cage 200 for connection to a baseball simulator 100, 101, or 102 that is attached to a three-dimensional resistance means for the purpose of providing strengthening, rehabilitation, and/or correct body motion mechanics training to improve pitching quality, speed, strength, and body mechanics.

Making the device of the present invention can be accomplished to achieve utility with any weight or force of resistance up to at least ten kilograms. However, the best known weight or force of resistance range for exercise, training, and rehabilitation of the muscles and body motion mechanics involved in the act of pitching a baseball are known to be most usefully limited to weights or forces of resistance up to approximately one kilogram and weights or forces of resistance up to five kilograms.

Making the device of the present invention involves the use of any suitable material capable of providing a strength to weight ratio sufficient to maintain the rigidity of the device when extended up to two meters from a surface to which it is attached. Various solid metal rods and hollow metal tubes made from stainless steel, carbon fiber, and some higher strength plastics are readily suited to use to embody the present invention.

The device or apparatus of the present invention starts at the connection of a baseball simulator 100, 101, or 102 wherein an attachment rod 110 is inserted into the baseball simulator 100, 101, or 102 passing through the exterior of the baseball simulator 100, 101, or 102 and terminating at the center of the baseball simulator 100, 101, or 102. Termination in the center means that the attachment rod 110 extends inward towards and extending to the physical, geographic, and/or dimensional center of the baseball simulator 100, 101, or 102.

Figure 3:
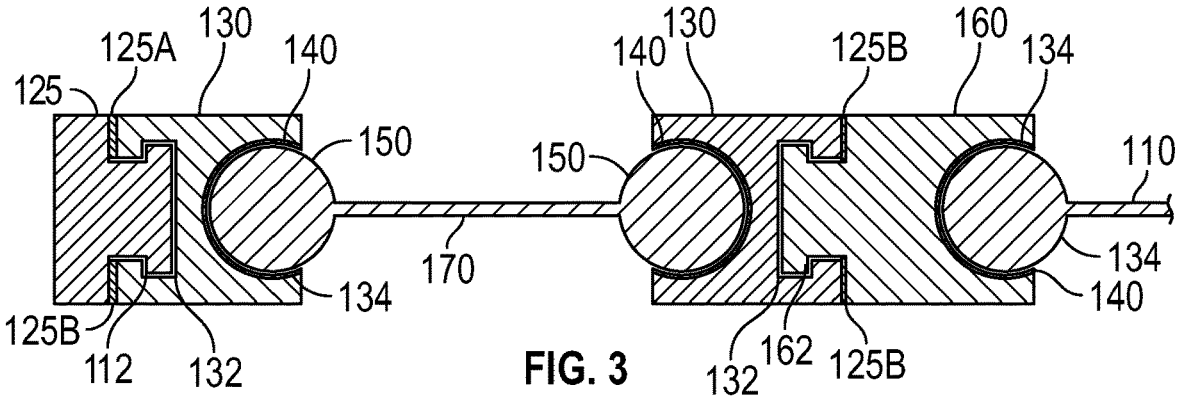
FIG. 3 is a cross section view of the straight connection rotatable ball joints showing a rotatable ball joint base having a sleeved ball joint and a dual ball joint straight connection rotatable ball joint having a sleeved ball joint and a rotatable sleeved ball joint according to the invention.
Figure 4:
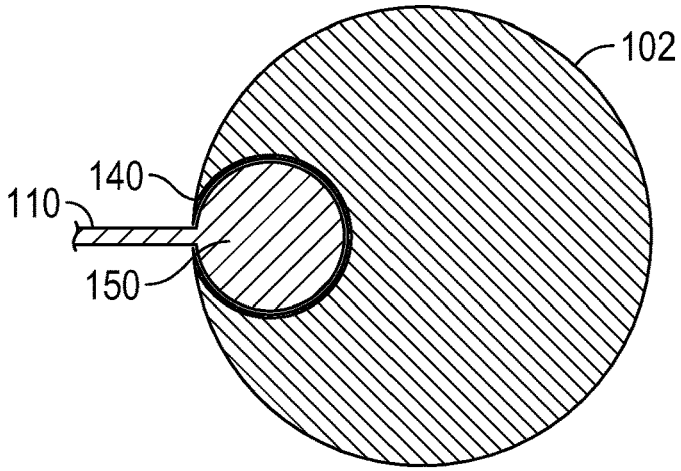
FIG. 4 is a cross section view of an alternate baseball simulator showing the ball joint used in said alternate baseball simulator to connect to the attachment rod according to the invention.
Figure 5:
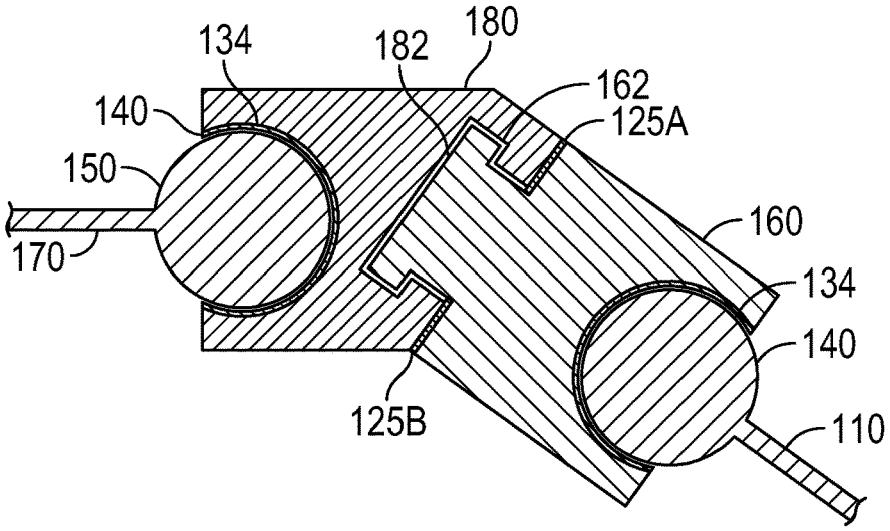
FIG. 5 is a cross section view of the angled connection rotatable ball joint showing an angled rotatable joint and the sleeved ball joints of said angled connection rotatable ball joint according to the invention.
Figure 6:
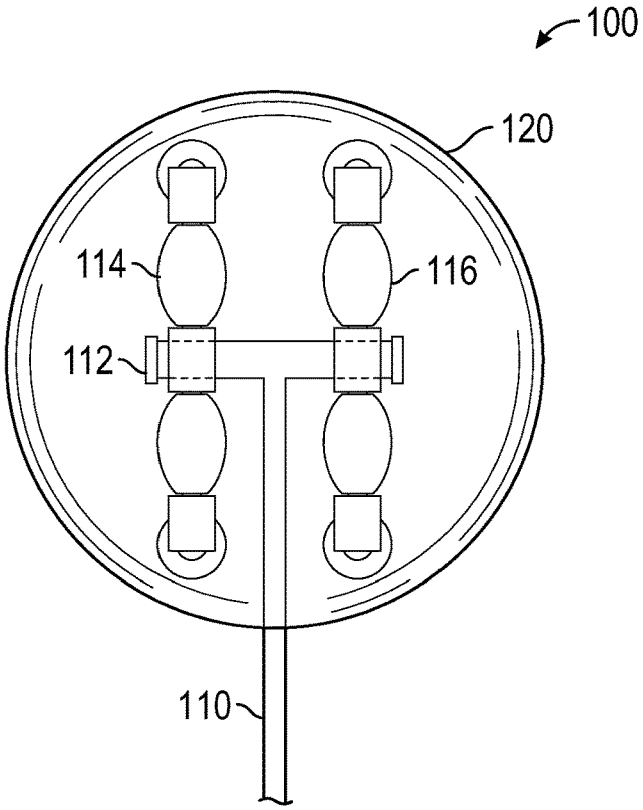
FIG. 6 is a perspective view of the baseball simulator showing the attachment rod connected to an axel having two omni-directional wheels attached which are freely rotatable internally mounted according to the invention.
Figure 7:
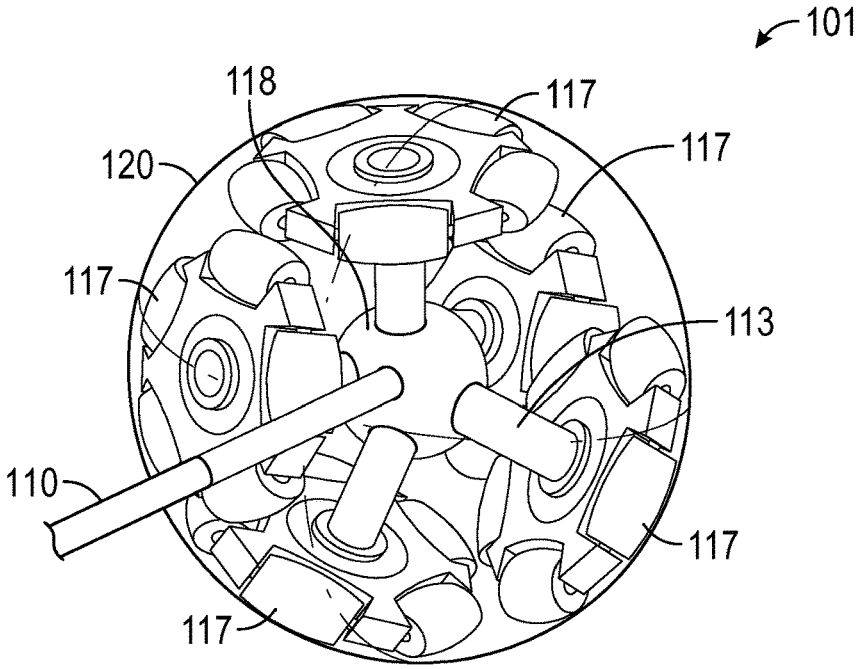
FIG. 7 is a perspective view of the baseball simulator showing the attachment rod connected to an axel having five omni-directional wheels attached which are freely rotatable internally mounted according to the invention.

There are at least the two means presented herein, and shown in FIG. 3 and FIG. 4, to enable the spin or rotation of a baseball simulator 100, 101, or 102 about an attached attachment rod 110 connected to the center of a baseball simulator 100, 101, or 102. Each axel has connected an omni-directional wheel 117 connected at each wheel position to enable spin and/or rotation of an attached attachment rod 110 and thus the spin or rotation of the baseball simulator 100, 101, or 102 about the attachment rod 110. Further, there is at least the means presented herein, to enable the spin or rotation of a baseball simulator 100, 101, or 102 about an attached attachment rod 110 connected to the interior of a baseball simulator 100, 101, or 102 using a ball joint 130 and a spherical socket 134.

Creating a rotatable connection is embodied in using a combination of a ball joint 130 having a rotatable connection head 162 used with or without a rotating ring 125 wherein said rotatable connection head 162 is inserted to enable operationally spinning into an axially rotating joint connection head receiver 132 element of a ball joint 130 for mating and connection to ball component 150 used with or without a ball sleeve 140. This combination may be further extended by further incorporating at least one rotating ball joint comprising a rotatable sleeved ball joint 160 having a rotatable sleeved ball joint connection head 162 and spherical socket 134 and/or at least one angled rotating ball joint comprising an angled rotatable sleeved ball joint 180 having an angled rotatable sleeved ball joint connection head 182 and spherical socket 134 using connection rods 170 to connect ball components 150 thereby enabling rotating or spinning extendable connections.

In an embodiment of a manufacturing method there are engineered dimensions for all elements of the present invention such that tolerances in dimension and dimensional match between elements are designed to result in an ease of movement or smoothness of movement of the device or apparatus of the present invention.

In an alternate embodiment of a manufacturing method there are additional bands, not shown, wrapped about and around the rotating ball joints of all types to tighten the connection and control or limit the movement of the rotating ball joint to tighten the ball joint connection between the ball and the socket.

The spherical cage 200 is used for connecting to and holding a baseball simulator 100, 101, or 102 in a position for a user to train or exercise. The spherical cage 200 is assembled from a hemispherical frame 210 having an exercise machine attachment point 270 and two operational connection points 230 for holding an outer ring 220. The outer ring 220 can additionally be assembled from a series of nested or mated bands or rings in any combination of spherical band or ring 220, inner ring 250, and/or spherical rotating ring 260 configured to rotate within themselves enabling the attachment point 250 for connecting a baseball simulator 100, 101, or 102 to spin axially about its exercise machine connection point 270.

In a preferred embodiment, there is a baseball simulator 100, 101, or 102 comprising a spherical cage 200 having an opening surrounding an attachment rod 110 having a free end opposite an attachment end, and a first axel 112 comprising a first wheel 114 opposite a second wheel 116 operatively attached at a first axel 112 midpoint between said first wheel 114 and said second wheel 116 to said attachment end.

In an alternate embodiment, there is a baseball simulator 100, 101, or 102 wherein said first axel 112 further comprises a rotating axel 118 connection operatively connecting said first axel 112 midpoint to said attachment end of said attachment rod 110.

In an alternate embodiment, there is a baseball simulator 100, 101, or 102 further comprising a second axel 113 configured with a third wheel operationally attached at a second axel 113 midpoint to said attachment end of said attachment rod 110.

In an alternate embodiment, there is a baseball simulator 100, 101, or 102 further comprising a plurality of axels, one of said plurality of axels being said first axel 112, having attached a plurality of wheels, one of said plurality of wheels being said first wheel 114.

In an alternate embodiment, there is a baseball simulator 100, 101, or 102 where any wheel further comprises an omni-directional wheel 117.

In a preferred embodiment, there is a pitch training attachment to a mechanical exercise training system (METS) for training people to pitch a baseball comprising a baseball simulator 100, 101, or 102 having an attachment rod 110 operationally attached to said METS.

In an alternate embodiment, there is a pitch training attachment further comprising a spherical cage 200 having an attachment rod connector 240 operationally attached to said attachment rod 110 and a machine connector operationally attached to said METS.

In an alternate embodiment, there is a pitch training attachment wherein said spherical cage 200 is configured for spinning about a center of said spherical cage 200.

In an alternate embodiment, there is a pitch training attachment wherein said machine connector is configured for turning axially about its connection to said METS.

In an alternate embodiment, there is a pitch training attachment wherein said machine connector is configured for rotating about its connection to said METS.

In an alternate embodiment, there is a pitch training attachment further comprising a first connection rod 170, a rotating ball joint 130 having a rotating base, a first socket 134, a first ball 150, and a first connection end, and an angled rotating ball joint 180 having a base, a second socket 134, a second ball 150, and a second connection rod 170 wherein said first connection end is connectively attached to said first connection rod 170, said rotating base is operationally attached to said base, and said attachment rod 110 is connectively attached to said second connection rod 170.

In an alternate embodiment, there is a pitch training attachment wherein said rotating ball joint 130 further comprises a first spherical sleeve 140 inserted between said first ball 150 and said first socket 134, and said angled rotating ball joint 180 further comprises a second spherical sleeve 140 inserted between said second ball 150 and said second socket 134.

In an alternate embodiment, there is a pitch training attachment wherein said attachment rod 110 is connectively attached to an axel having a first omni-directional wheel 117 and a second omni-directional wheel 117 at opposing ends.

In an alternate embodiment, there is a pitch training attachment wherein said axel further comprises at least a third omni-directional wheel 117.

In an alternate embodiment, there is a pitch training attachment wherein said baseball simulator 100, 101, or 102 further comprises a ball joint 130 having a third ball 150, a third socket 134, and a third connection rod 170 wherein said attachment rod 110 is connectively attached to said third connection rod 170.

In an alternate embodiment, there is a pitch training attachment wherein said ball joint 130 further comprises a spherical sleeve 140 inserted between said third ball 150 and said third socket 134.

In an alternate embodiment, there is a pitch training attachment wherein said METS further comprises a three-dimensional resistance machine.

In an alternate embodiment, there is a pitch training attachment wherein said METS further comprises a controlled motion three-dimensional exercise machine.

In an alternate embodiment, there is a pitch training attachment further comprising a spherical cage 200 configured to position said baseball simulator 100, 101, or 102 in its center.

In an alternate embodiment, there is a pitch training attachment further comprising a spherical cage 200 operatively attached to said second connection rod 170 configured to position said baseball simulator 100, 101, 102 in its center.

An advantage of the pitch training device or apparatus of the present invention is that it enables training, exercising, and rehabilitation of proper body motion mechanics for improving the act of pitching and increasing the performance (speed and/or accuracy) of the act by enabled weighted ball training wherein the weight of the ball is connected to and maintained in the center of the ball and the center of mass of the weight is maintained in the center (physical, geometric, and/or dimensional) of the ball.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A pitch training attachment to a mechanical exercise training system (METS) for training people to pitch a baseball comprising a baseball simulator having an attachment rod operationally attached to said METS wherein said attachment rod is connectively attached to an axel having a first omni-directional wheel and a second omni-directional wheel at opposing ends.

2. The pitch training attachment of claim 1 wherein said axel further comprises at least a third omni-directional wheel.

3. The pitch training attachment of claim 1 further comprising a spherical cage having an attachment rod connector operationally attached to said attachment rod and a machine connector operationally attached to said METS.

4. The pitch training attachment of claim 3 wherein said spherical cage is configured for spinning about a center of said spherical cage.

5. The pitch training attachment of claim 3 wherein said machine connector is configured for turning axially about a connection to said METS.

6. The pitch training attachment of claim 3 wherein said machine connector is configured for rotating about a connection to said METS.

7. The pitch training attachment of claim 2 further comprising a first connection rod, a rotating ball joint having a rotating base, a first socket, a first ball joint, and a first connection end, and an angled rotating ball joint having a base, a second socket, a second ball joint, and a second connection rod wherein said first connection end is connectively attached to said first connection rod, said rotating base is operationally attached to said base, and said attachment rod is connectively attached to said second connection rod.

8. The pitch training attachment of claim 7 wherein said rotating ball joint further comprises a first spherical sleeve inserted between said first ball joint and said first socket, and said angled rotating ball joint further comprises a second spherical sleeve inserted between said second ball joint and said second socket.

9. The pitch training attachment of claim 2 wherein said baseball simulator further comprises a ball joint having a third ball joint, a third socket, and a third connection rod wherein said attachment rod is connectively attached to said third connection rod.

10. The pitch training attachment of claim 9 wherein said ball joint further comprises a spherical sleeve inserted between said third ball joint and said third socket.

11. The pitch training attachment of claim 2 wherein said METS further comprises a three-dimensional resistance machine.

12. The pitch training attachment of claim 2 wherein said METS further comprises a controlled motion three-dimensional exercise machine.

13. The pitch training attachment of claim 2 further comprising a spherical cage configured to position said baseball simulator in a center.

14. The pitch training attachment of claim 7 further comprising a spherical cage operatively attached to said second connection rod configured to position said baseball simulator in a center.

* * * * *